United States Patent [19]

Mezak

[11] Patent Number: 4,500,858

[45] Date of Patent: Feb. 19, 1985

[54] METHOD FOR ENHANCING FERROMAGNETIC COUPLING

[75] Inventor: John A. Mezak, San Jose, Calif.

[73] Assignee: Eaton Corporation, Cleveland, Ohio

[21] Appl. No.: 448,689

[22] Filed: Dec. 10, 1982

[51] Int. Cl.[3] ..... H01P 1/20; H01P 5/02; H01P 1/218

[52] U.S. Cl. ..... 333/202; 333/24 R; 333/205; 333/207; 333/219

[58] Field of Search ..... 333/24.1, 33, 35, 24 R, 333/202-212, 218-223, 27; 329/1-2, 104, 160-164, 204, 206, 203, 116; 455/325-328, 331, 332; 307/320

[56] References Cited

U.S. PATENT DOCUMENTS

| | | | |
|---|---|---|---|
| 3,435,385 | 3/1969 | Cohen | 307/320 X |
| 3,562,651 | 2/1971 | Hoover et al. | 455/326 |
| 3,614,676 | 10/1971 | Boelke | 333/35 X |
| 4,283,694 | 8/1981 | Pauker | 333/35 |
| 4,342,008 | 7/1982 | Jewett | 333/218 X |

FOREIGN PATENT DOCUMENTS

| | | | |
|---|---|---|---|
| 606759 | 8/1948 | United Kingdom | 333/35 |

OTHER PUBLICATIONS de Bruyne, "YIG-Filters and Devices", Philips Electronic Meas. No. 2, 1969; pp. 13-16.

*Primary Examiner*—Marvin L. Nussbaum
*Attorney, Agent, or Firm*—Andrus, Sceales, Starke & Sawall

[57] ABSTRACT

The variation in the external bandwidth of input and output resonators of YIG filters and of single resonator device, is corrected by means of frequency selective impedance transformers. The transformers are comprised of specific impedance transmission lines which may be incorporated as integral parts of the YIG filter RF circuit.

2 Claims, 16 Drawing Figures

METHOD FOR ENHANCING FERROMAGNETIC COUPLING

BACKGROUND

1. Field

This invention pertains to improvements in ferromagnetic bandpass filters such as YIG filters, and more particularly, to improvements in the response of such filters made possible through the use of integral compensating impedance transformers.

2. Prior Art

An ideal multi-stage YIG bandpass filter exhibits a constant bandwidth and passband shape over its entire range. Achieving this ideal requires constant coupling between filter resonators as well as constant coupling to the input and output resonators over the desired tuned range of the filter. Where constant couplings cannot be achieved, it would then be desirable as an alternative to provide couplings which change at the same rate in order to obtain a constant passband shape and a low equal ripple passband VSWR. Neither of these alternative sets of conditions has been achieved previously over multi-octave tuning ranges by ferromagnetic devices which incorporate loop coupling.

The bandwidth of the input and output resonator of a multi-section YIG filter as well as the bandwidth of a single stage YIG filter vary with tuning frequency. These changes in bandwidth are dependent upon the coupling loop reactance and upon variation of RF current along the length of the coupling loop, both of which change with frequency. FIG. 1 is a graph which provides an example of the change in the input stage bandwidth ($BW_c$) 101 and also the adjacent resonator peak to peak bandwidth $\Delta fp$ 102 as a function of resonator frequency. In FIG. 1, the ordinate 104 represents the bandwidth in megahertz while the abscissa 103 represents the center frequency in GHz. Curve 101 is plotted for a typical three-quarter turn loop while curve 102 is plotted for a typical half-turn loop.

The input stage bandwidth variation causes the filter passband VSWR and insertion loss ripple to change substantially over broad multi-octave tuning ranges. In addition, it can be seen from FIG. 1 that the adjacent resonator bandwidth obtained with typical loop structures produce relatively constant filter bandwidth at low RF frequencies, whereas the input bandwidth varies rapidly. At the higher frequencies, the adjacent resonator bandwidth increases substantially with frequency, whereas the input bandwidth decreases with frequency. In general, decreased input and output stage bandwidth causes increased passband ripple. Consequently, prior art multi-octave tuning range filters have a relatively large passband ripple over an appreciable part of their tuning range.

A commonly used approach for decreasing the filter passband ripple in prior art devices is to choose coupling loops with minimum bandpass variation over the frequency range of interest. A second commonly used approach is to degrade the unloaded Q of the resonators and thereby cause a substantial increase in filter insertion loss and concomitant rounding of the passband shape.

There are two prior art U.S. patents relating to this area of tunable filter, but neither discloses a means of providing constant bandwidths over wide frequency ranges. Although the first of these, U.S. Pat. No. 3,435,385, illustrates the use of variable capacitors in the form of varactor diodes to vary coupling in YIG filters, it does not disclose impedance transforming sections designed to achieve constant bandwidth.

The second of these prior art patents, U.S. Pat. No. 3,400,343, claims a first stripline feed to the first input resonator and a second stripline feed to the last output resonator, however, it does not disclose the use of stripline as an input compensating transformer. Additional background information for the present invention may be found in my prior U.S. Pat. Nos. 4,247,837 and 3,562,651.

SUMMARY

An object of the present invention is to provide a reduced change in the input and output resonator bandwidth of a filter as a function of frequency.

An object of the present invention is to provide a change in input and output resonator bandwidth which matches the change in adjacent resonator bandwidth over the tuning range of the filter in order to provide a constant passband ripple as a function of tuned frequency.

To overcome the disadvantage of the prior art and substantially reduce filter bandpass ripple without appreciable loss over the tuning range of the filter, the present invention incorporates in combination a frequency selective impedance transformer and a ferrite filter element in the input and output coupling loops of the filter. The frequency selective nature of the transformer is used to compensate for the variations in coupling over the frequency range of interest, producing relatively flat coupling over a multi-octave range of 4 to greater than 20 GHz in practical devices.

DETAILED DESCRIPTION OF THE INVENTION

Figure 1:
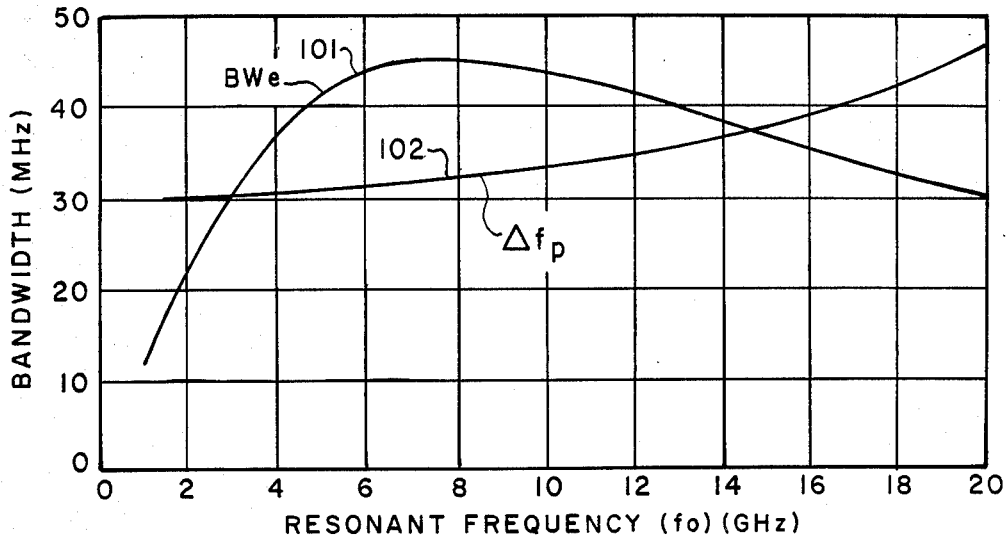
FIG. 1 is a graph showing the calculated input and output bandwidth ($BW_c$) of a ferromagnetic resonator filter, in which a three-quarter turn loop is used, and the calculated adjacent resonator bandwidth ($\Delta fp$), in which one-half turn loop is used.

This invention incorporates a unique RF transformer designed to improve the passband response of YIG bandpass filters over the tuning range of the filter by substantially reducing the ripple incurred in prior art devices. The passband response of prior art devices is determined by the variation of input and output bandwidth ($BW_e$) and by variation of adjacent resonator bandwidth ($\Delta fp$), over the tuned range of the filter. FIG. 1 provides a plot of the calculated input or output bandwidth ($BW_e$) 101, for a typical three-quarter turn loop as a function of tuned frequency. Also presented in this Figure is a plot of the adjacent resonator bandwidth ($\Delta fp$) 102 for a typical half-turn loop as a function tuned frequency. In a properly designed equal ripple passband filter, the adjacent resonator bandwidth 101 controls the filter bandwidth. FIG. 1, therefore, shows the increase of filter bandwidth with increasing tuned frequency. In general, for any number of filter resonators, decreased input and output bandwidth relative to adjacent resonator bandwidth is concomitant with increased passband ripple and is not normally desirable.

In FIG. 1, the input and output resonator bandwidth 101 can be seen to change significantly over the 1 to 20 GHz tuning range of the filter when compared to the adjacent resonator bandwidth 102. As noted, the general object of this invention is to provide a reduced change in the input and output resonator bandwidth as a function of tuned frequency. A more specific object is to provide a change in input and output resonator bandwidth which matches the change in adjacent resonator bandwidth over the tuned range of the filter in order to provide a constant passband ripple as a function of tuned frequency. The calculations for FIG. 1 are obtained from the analysis of the equivalent circuit of the loop coupled ferromagnetic resonator illustrated in FIGS. 2A and 2B.

Figure 2A:
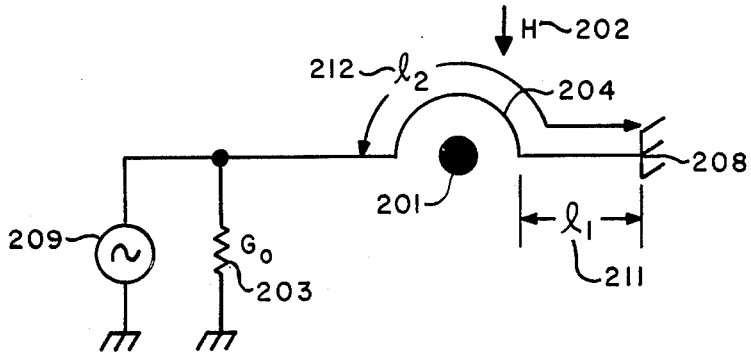
FIG. 2A is a schematic representation illustrating the equivalent circuit of the input and output resonator of a ferromagnetic resonator filter.

The circuit of FIG. 2A comprises a source generator 209, a source admittance 203, a coupling loop 204 positioned about ferromagnetic resonator 201, and line lengths $l_1$ 211 and $l_2$ 212, which are defined below in connection with equation 1. The source generator and conductance are connected in parallel and supply one end of the coupling loop. The opposite end of the loop is grounded at point 208. Ferromagnetic resonator 201, when biased by a static DC magnetic H-field 202, resonates at a frequency of $\omega_o = 2\pi\gamma$ H where $\gamma = 2.8$ MHz/oersteds. The resonate sphere 201 is coupled to the source admittance $G_o$ 203, by the coupling loop 204, and produces an equivalent parallel resonant circuit, comprising $L_y$ 205, and $C_y$ 206 which are located at the short circuit end of the coupling loop 208, as shown in FIG. 2A.

Figure 2B:
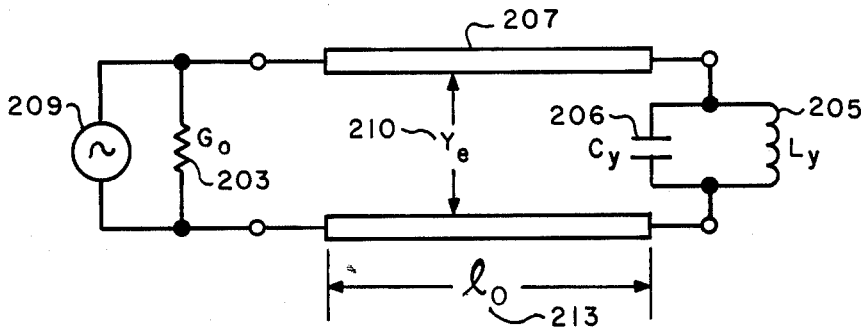
FIG. 2B is a lumped element equivalent circuit for the filter of FIG. 2A.

FIG. 2B comprises the source generator 209, the source admittance $G_o$ 203, a transmission line 207 having an admittance $Y_l$ 210 and a length $l_o$ 213, and a parallel resonant circuit comprising a capacitor $C_y$ 206 and an inductor $L_y$ 205. The source admittance $G_o$ 203 is connected in parallel across one end of the transmission line 207, while the parallel resonant circuit formed of $C_y$ and $L_y$ are connected across the opposite end.

For loop coupled ferromagnetic resonant circuits, the equivalent inductance $L_y$ is given by Equation 1.

$$L_y = \frac{\mu_o \omega_m V_m (\sin \beta l_2 - \sin \beta l_1)^2}{\omega_o \, 16\pi^2 r^2 \beta^2} \qquad \text{Equation 1}$$

where $L_y$ = inductance in henries $\mu_o$ = permeability of free space $1.256 \times 10^{-6}$ henries/meter $V_m$ = volume of the YIG sphere in meters$^3$ $\beta$ = propagation velocity the medium, in radians/meter $l_2$ = length of the coupling loop from the short circuit to the end of coupling loop, in meters $l_1$ = length of the coupling loop from the short circuit to the start of coupling loop, in meters $\omega_o$ = resonant frequency of the sphere in radians/second r = radius of the coupling loop in meters and $$\omega_m = \mu_o \gamma M_s$$

where $\gamma$ = gyromagnetic ratio, $1.759 \times 10^{11}$ (MKS units)

$M_s$ = saturation magnetization of the material (MKS units)

The sine terms in Equation 1 account for the cosine variation of RF current along the length of the loop. The equivalent capacitance $C_y$ of the resonant circuit is obtained from Equation 2.

$$\omega_o^2 = \frac{1}{L_y C_y} \qquad \text{Equation 2}$$

It is important to note that the coupling loop 204, can be treated as a transmission line 207, with a characteristic admittance, $Y_l$ and length $l_o$. Consequently, the coupling loop will transform $G_o$ 203 to an equivalent conductance $G_p$ across the lumped element resonator by the real part of the transformer expression:

$$G_p = R_e \left[ Y_l \frac{G_o + j\, Y_l \tan \beta l_o}{Y_l + j\, G_o \tan \beta l_o} \right] \qquad \text{Equation 3}$$

The external quality factor $Q_e$ of the input and output resonator in the filter is given by Equation 4.

$$Q_e = \frac{f_o}{BW_e} = \frac{1}{\omega_o L_y G_p} \quad \text{Equation 4}$$

Part of the variation in bandwidth found in prior art devices is due to the transformation of $G_o$ to $G_p$. This transformation is largely unrecognized and was previously not compensated.

Figure 3A:
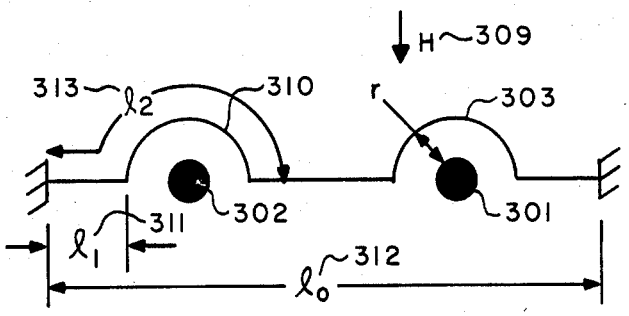
FIG. 3A is a schematic representation illustrating the physical equivalent circuit of adjacent resonators in a ferromagnetic resonator filter in which loop coupling is utilized.
Figure 3B:
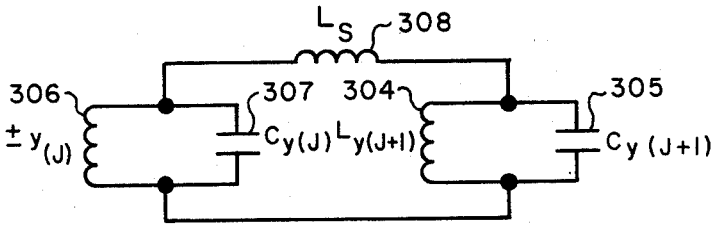
FIG. 3B is a lumped element equivalent circuit for the filter of FIG. 3A.

The equivalent circuit for the coupling between adjacent resonators is shown in FIG. 3A and 3B. FIG. 3A comprises first and second ferromagnetic resonator 301 and 302, with corresponding first and second coupling loops 303 and 310, respectively. The loops are connected in series at one end while the remaining free ends of the loops are grounded. The length of the line from ground to the beginning of a loop is referred to as $l_1$ and designated 311. The length of line from ground to the end on one loop is referred to as $l_2$ and is designated 313. The total length of the lines and loops from ground to ground is referred to as $l_o$ and designated by drawing numeral 312.

FIG. 3B comprises two parallel resonant circuits each grounded at one end and connected together at their opposite ends by an inductance $L_s$ 308. The first resonant circuit comprises $L_{y\,(j+1)}$ 304 and $C_{y\,(j+1)}$ 305, while the second comprises $L_{y(j)}$ 306 and $C_{y(j)}$ 307. Both ferromagnetic resonators, 301 and 302, are coupled by loops 303 and 310 and are biased by a static H-field 309. The series coupling loops 303 and 310 can be equated to a semi-lumped element inductance given by Equation 5.

$$L_s = \frac{1}{\omega_o Y_l} \operatorname{Sin} \beta l_o \quad \text{Equation 5}$$

where $Y_l$=characteristic admittance of the loops, in ohms $l_o$=overall length of the loops in meters The bandwidth between adjacent resonators therefore is given by Equation 6.

$$\Delta fp = Kf_o = \frac{\sqrt{L_{y(j)} L_{y(j+1)}}}{L_s} \cdot fo \quad \text{Equation 6}$$

where $\Delta$fp=peak to peak bandwidth of adjacent resonators in MHz

K=coupling coefficient $L_{y(j)}$=equivalent inductance of the jth resonator in henries $L_{y(j+1)}$=equivalent inductance of the $j^{th}$ resonator in henries The value of the equivalent inductance Ly is obtained from Equation 1.

The calculations used in providing the data to produce the curves in FIG. 1 were based upon the following typical parameter values.

Ferromagnetic Material $M_s = 1.272 \times 10^5$ ampere-turns/meter $V_m = 2.35 \times 10^{-11}$ meters$^3$ Input and output use 3/4 turn loop $l_1 = 0.33 \times 10^{-3}$ meter $l_2 = 2.31 \times 10^{-3}$ meter $l_0 = 2.64 \times 10^{-3}$ meter $r = 0.42 \times 10^{-3}$ meter $Y_l$=0.008 Seimen (mHos)

Adjacent Resonator ½ Turn Loops $l_1 = 0.30 \times 10^{-3}$ meter $l_2 = 1.75 \times 10^{-3}$ meter $l_0 = 4.37 \times 10^{-3}$ meter $r = 0.412 \times 10^{-3}$ meter $Y_l$=0.008 Seimen (mHos)

This invention makes use of an admittance transforming network between the source conductance and input coupling loop, and between the load conductance and output coupling loop. One embodiment of the network is a quarter wavelength coaxial line transformer, shown in FIG. 4A and 4B.

Figure 4A:
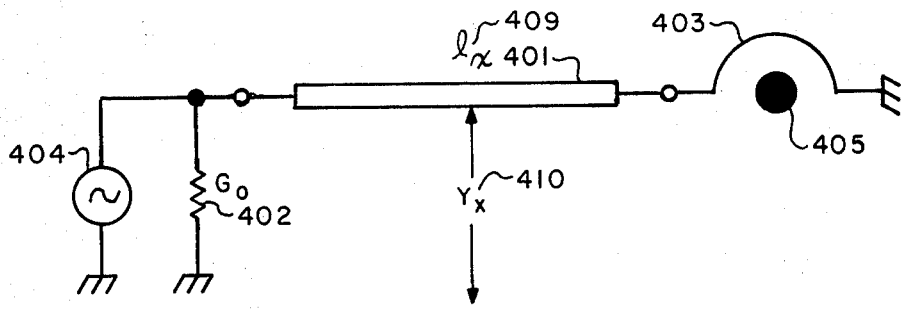
FIG. 4A is a schematic representation illustrating the use of and the physical equivalent circuit of a transmission line compensating transformer positioned between the input source (or output load) and the input (or output) coupling loop of a filter.

FIG. 4A comprises a source generator 404, a source admittance 402, a transmission line 401, and a coupling loop 403 which is positioned about a ferromagnetic resonator 405. The source generator and the source admittance are connected in parallel with one terminal being grounded while the opposite terminal is connected to one end of the transmission line 401. The opposite end of the transmission line is connected to one end of the coupling loop while the remaining end of the coupling loop is grounded. The transmission line has a length of $l_x$ 409 and a characteristic admittance $Y_x$ 410.

Figure 4B:
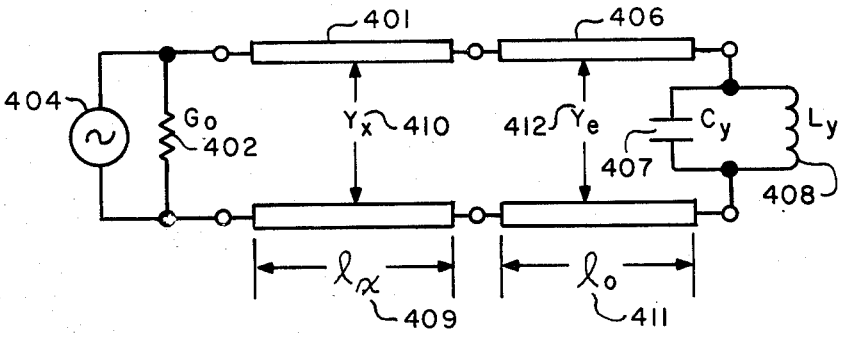
FIG. 4B is a lumped element equivalent circuit for the filter of FIG. 4A.

FIG. 4B comprises the source generator, source conductance and transmission line as described in connection with FIG. 4A, but also comprises a second line 406 and a parallel resonant circuit formed of capacitor $C_y$ 407 and inductor $L_y$ 408. The second line 406 is connected in series with the first and the parallel resonant circuit terminates the second line. The length of the second line is $l_o$ 411 and its admittance is 412. The second line represents the transmission line portion of the coupling loop 403, while the parallel resonant circuit represents the resonant characteristic of the ferromagnetic resonator 405.

One approach to the design of a transmission line transformer represented by transmission line 401 in FIG. 4 is to choose the characteristic admittance $Y_x$ such that it transforms the source conductance $G_o$ 402, into the characteristic admittance $Y_l$ of the coupling loop 403. This prevents the coupling loop 403 from acting as a transformer over a part of the tuning range of the filter. Increased coupling at the high end of the RF tuning range, which varies in the same way as the filter bandwidth (for constant passband ripple), is desired. Therefore, the length of the transformer 401 should be a quarter wavelength at or near the high end of the tuning range; however, the ripple is reduced significantly when the length ranges between one-eighth and three-eighths of a wavelength at the highest operating frequency of the device.

Figure 5:
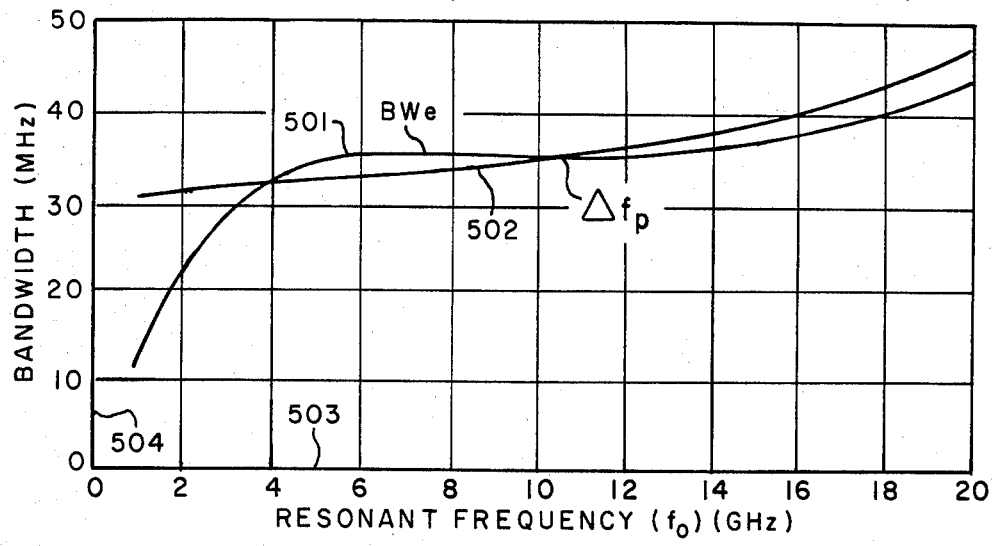
FIG. 5 is a graph showing the calculated input and output coupling ($BW_c$) of the ferromagnetic resonator filter obtained for a transmission line compensating transformer used with the coupling loop of FIG. 1.

The above design approach was used in calculating the data shown in the graph of FIG. 5. In this example, a 0.0125 mhos transforming line, one-quarter wavelength long at 25 GHz is considered as being inserted between the source or load conductance of 0.020 mhos and the input or output coupling loop of 0.008 mhos.

In FIG. 5, the ordinate 504 represents the bandwidth in megahertz, and the abscissa 503 represents the resonant frequency in gigahertz. The external bandwidth $BW_e$ is shown in plot 501 while the adjacent resonator bandwidth $\Delta f_p$ is shown in plot 502. The external bandwidth 501 closely matches the adjacent resonator bandwidth 502 (and 102 in FIG. 1) and would therefore provide a low approximately 0.1 dB equal ripple passband response in a three resonator filter.

Figure 6:
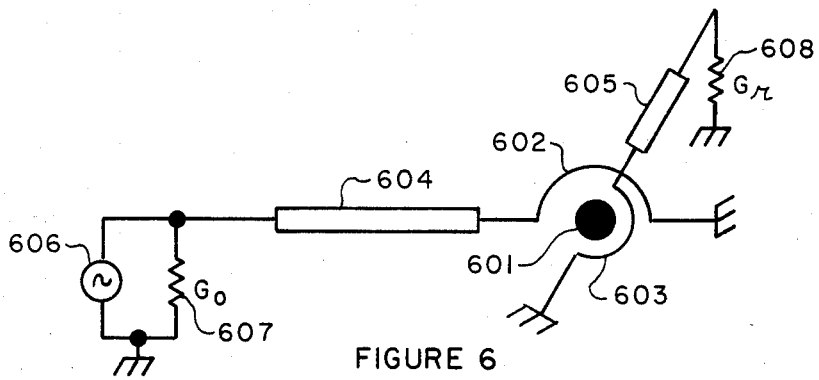
FIG. 6 is a schematic representation of a single resonator, ferromagnetic bandpass filter, incorporating compensating transmission line transformers.

The present invention is also applicable to single resonator ferromagnetic devices. The bandwidth of a single resonator bandpass filter would vary according to curve 101 of FIG. 1 over the tuning range of the filter. A compensating network would make it possible to obtain constant filter bandwidth over this tuning range. FIG. 6 shows a schematic of a bandwidth compensated single resonator filter comprising a source generator 606, a source admittance $G_o$ 607, a first transmission line transformer 604, a first coupling loop 602, a second coupling loop 603, a ferromagnetic resonator 601 and a load conductance $G_r$ 608. The source generator and source conductance are connected in parallel with one terminal being grounded and the other being connected to the one end of the first transmission line transformer. The opposite end of the first transmission line transformer is connected to one end of the first coupling loop while the other end of this loop is grounded. One end of the second coupling loop is grounded while the opposite end is connected to one end of the second transmission line. The opposite end of the second transmission line is connected to one end of the load conductance whose opposite end is grounded. In FIG. 6, the ferromagnetic resonator 601 is coupled to the source and load by orthogonal coupling loops 602 and 603 respectively. Compensation is provided by transmission line transformers 604 and 605.

Figure 7:
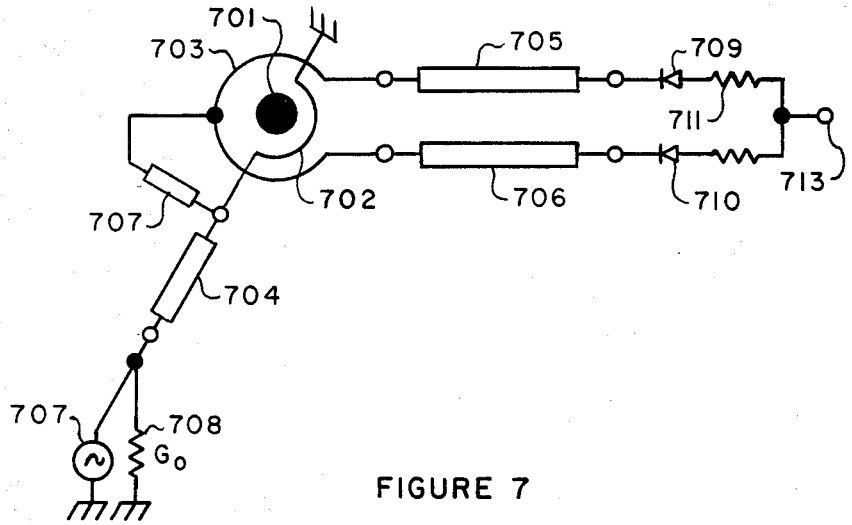
FIG. 7 is a schematic representation of a ferromagnetic resonance, frequency discriminator incorporating compensating transmission line transformers.

A second useful application of the present invention is in discriminator circuits. A single resonator ferromagnetic resonant device can be made to function as a frequency discriminator. However, in prior art devices, the discriminator bandwidth normally varied over the tuning range, resulting in a variation is discriminator sensitivity. FIG. 7 shows a compensated discriminator circuit employing the present invention.

FIG. 7 comprises a source generator 707, a source admittance $G_o$ 708, first, second and third transmission line transformers 704, 705 and 706, a line 707, a ferromagnetic resonator 701, first and second coupling loops 702 and 703, first and second detection diodes 709 and 710, summing resistors 711 and 712 and output port 713.

In this circuit, the source generator and source admittance are connected in parallel with one terminal connected to ground and the other terminal connected to one end of the first transmission line transformer 704. The opposite end of the first transmission line transformer is connected to one end of the first coupling loop while the opposite end of this loop is grounded. One end of the second coupling loop 703 is connected to one end of the second transmission line transformer 705, while the other end of this loop is connected to one end of the third transmission line transformer 706. The remaining ends of the second and third transmission line transformers are connected respectively to diodes 709 and 710 whose remaining terminals are connected to resistors 711 and 712, respectively. The remaining terminals of the resistors are connected together at output terminal 713. The transmission line 707 is connected between the junction of the first transmission line transformer and the first coupling loop to a center tap in the second coupling loop.

In the circuit of FIG. 7, the ferromagnetic resonator 701 is coupled to the two coupling loops 702 and 703. Transmission line transformers 704, 705 and 706 function as compensating networks in accordance with the invention to provide the desired bandwidth compensation while line 707 serves as a coupling element to provide the reference signal to the discriminator circuit.

A third application of the present invention is in balanced frequency converter or balanced mixer circuits. A tunable balanced frequency converter can be made from a single ferromagnetic resonator device, but prior art devices suffer from bandwidth variation over the tuning range of the device. A bandwidth compensated frequency converter is shown in FIG. 8.

Figure 8:
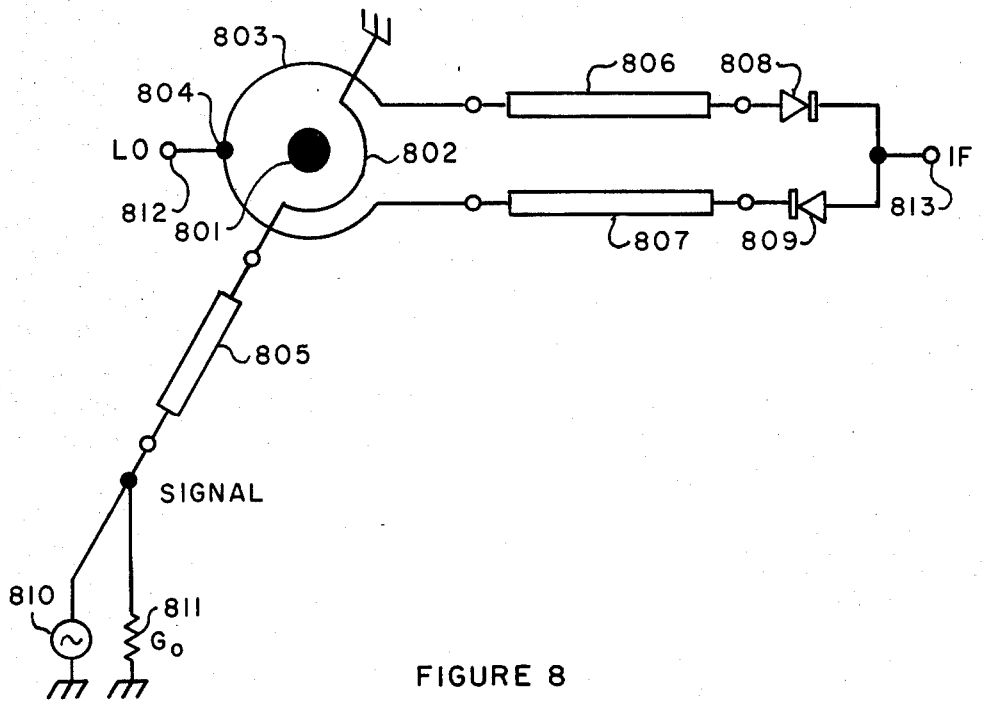
FIG. 8 is a schematic representation of a ferromagnetic resonance, balanced frequency converter, incorporating compensating transmission line transformers.

FIG. 8 comprises a source generator 810, a source admittance 811, first, second and third transmission line transformer 805, 806 and 807 respectively, first and second coupling loops 802 and 803 respectively, a ferromagnetic resonator 801, first and second diode detectors 808 and 809 respectively, LO port 812 and IF output port 813. The source generator and source admittance are connected in parallel with one terminal grounded while the other is connected to one end of the first transmission line (or input) transformer 805. The opposite end of the input transformer is connected to one end of the first coupling loop, while the opposite end of the loop is grounded. Each end of the second coupling loop is connected to one end of the second and third (or output) transmission line transformers. The opposite ends of the output transmission line transformers are connected to one of the detector diodes, whose opposite ends are connected together at IF output port 813. The LO port 812 is connected to a center tap 804 of the second (or balanced) coupling loop 803.

As in prior art devices, the ferromagnetic resonator 801 is coupled by the input coupling loop 802 and by a balanced output loop 803. The local oscillator signal (LO) is applied to the center tap 804 of the balanced loop. The input compensating transformer line 805 and output compensating transformer lines 806 and 807 are incorporated between the balanced output loop 803 and the mixer diodes 808 and 809.

The mixer operates in a conventional manner with both the RF signal from the source generator and the LO signal being fed to each diode; however, the insertion of the LO at the midpoint of the second loop isolates LO power from the RF or source generator port. The use of the ferromagnetic resonator permits tuning the mixer over the entire tuning range of this device while the addition of the transformers in accordance with the present invention reduces the bandwidth variation at any selected operating frequency within the tuning range of the ferromagnetic resonating device.

A fourth application of the present invention is in tunable ratio discriminator circuits. A tunable ratio frequency discriminator can be made from a single ferromagnetic resonator device, as shown in FIG. 9.

Figure 9:
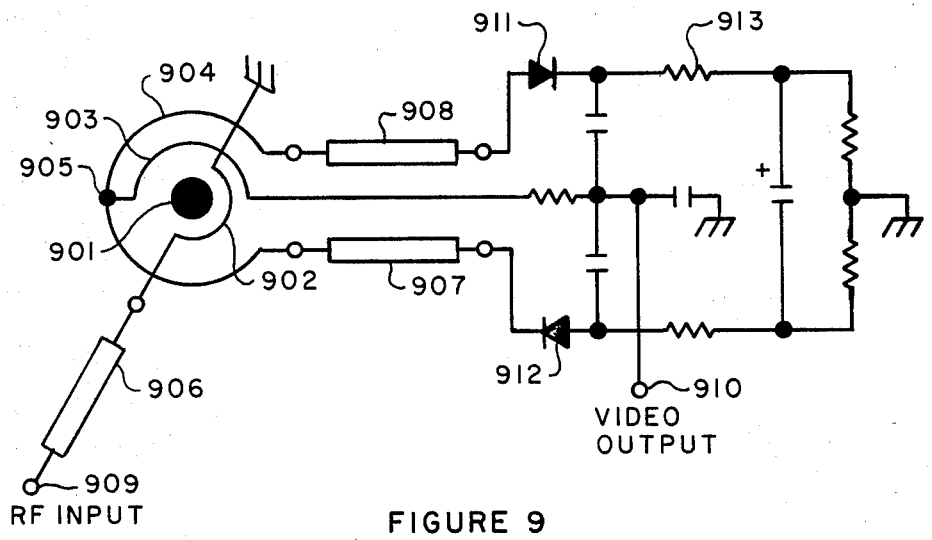
FIG. 9 is a schematic representation of a frequency discriminator ratio detector incorporating compensating transmission line transformers.

FIG. 9 comprises first, second and third transmission line transformers 906, 907 and 908 respectively, first, second and third coupling loops 902, 903 and 904 respectively, ferromagnetic resonator 901, first and second diodes 911 and 912, video circuitry 913, RF input port 909 and video output port 910. The RF input port is connected to one end of the first transmission line transformer while the opposite end of the transformer is connected to one end of the first coupling loop. The opposite end of this loop is grounded. The third coupling loop has each end connected to one of the diodes which have their opposite ends connected to the video circuitry. The second coupling loop is connected at one end to the midpoint of the third coupling loop, and at the other end to the video circuitry. It can be seen from this circuit that the input coupling loop 902 is coupled to the ferromagnetic resonator 901. The resonator 901 is coupled to the second unbalanced output coupling loop 903 and also to the third balanced coupling loop 904. The balanced coupling loop 904 has a center tap connection 905 which is connected to one end of the unbalanced coupling loop 903. The unbalanced coupling loop 903 provides the phase reference signal to the ratio discriminator and is usually more heavily coupled to the YIG resonator 902. The input compensating transformer 906 and output compensating transformers 907 and 908 provide constant external bandwidth over the tuning range of the discriminator and, therefore, constant discriminator sensitivity.

Figure 10A:
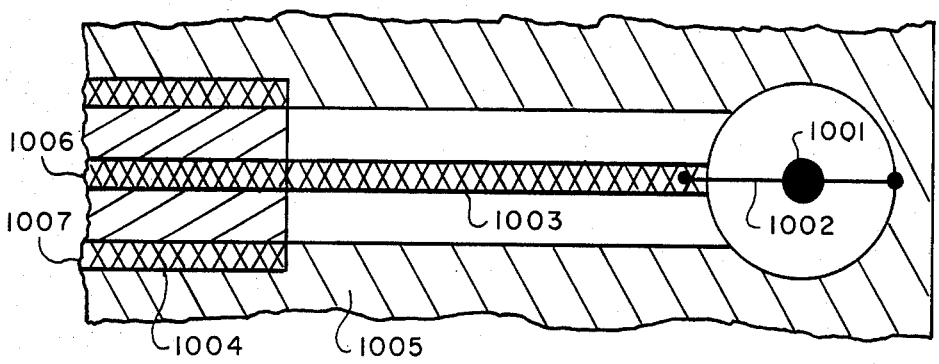
FIG. 10A is a top view of an embodiment of the invention incorporating a compensating transmission line transformer in a ferromagnetic resonator filter.
Figure 10B:
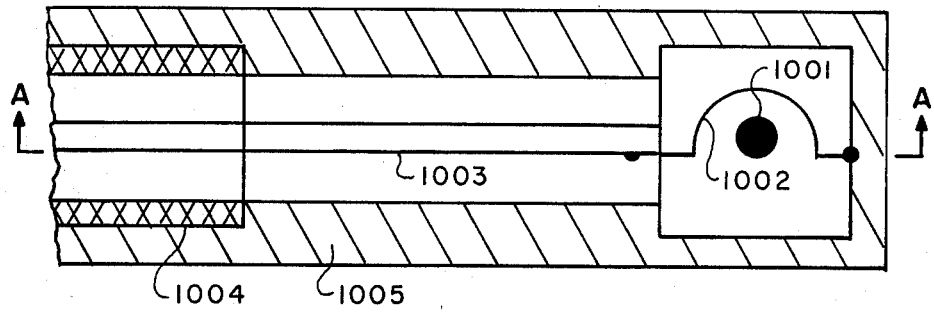
FIG. 10B is a side view of the filter of FIG. 10A.

Although transmission line transformers have been used for illustrative purposes throughout the above description of the invention, it is clear to those skilled in the art that such transformers may take a number of forms and yet remain within the scope of the present invention. The compensating network may be a coaxial transmission line transformer as previously discussed, and illustrated such as shown schematically in FIG. 4. One physical embodiment for an input circuit is illustrated in FIGS. 10A and 10B. In these Figures, a coupling loop 1001 surrounds a ferromagnetic resonator 1001. The loop is grounded at one end and connected at the other to a transformer. A ferromagnetic resonator 1001 is coupled to an input loop 1002. The coaxial line used as a transformer here is comprised of the center conductor 1003 and a metallic circuit housing 1005. The outer conductor of the transformer is machined into the circuit housing 1005 and may have any one of a number of cross section including circular, rectangular, square or triangular. One end of the transformer center conductor 1003 is connected to the normally used input coaxial center conductor 1006, while the outer conductor of the transformer surround and makes contact with the outer conductor 1007 of this input cable.

Figure 11:
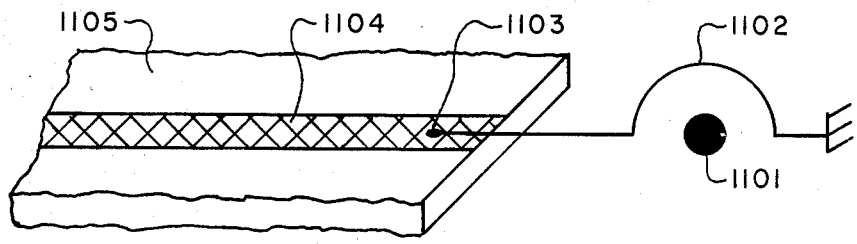
FIG. 11 is a schematic representation of the input coupling to a ferromagnetic resonator, incorporating a microstrip transmission line transformer for compensation.
Figure 12:
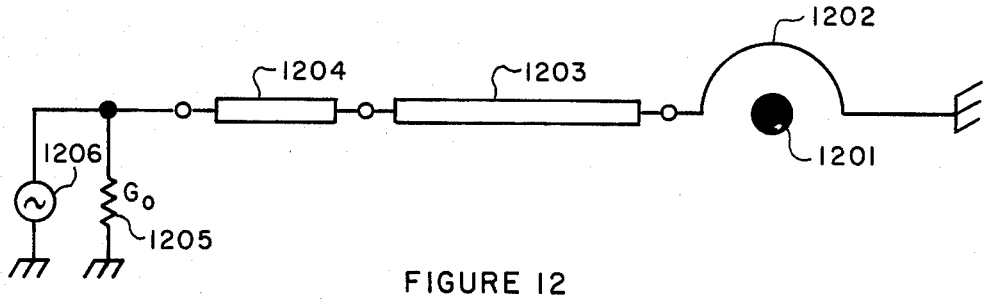
FIG. 12 is a schematic representation of the input coupling to a ferromagnetic resonator, incorporating a multi-section transmission line transformer for compensation.

The compensating network may also be a microstrip transmission line transformer as shown schematically in FIG. 11. This Figure comprises a printed circuit 1105, a printed line 1104, a coupling loop 1102 surrounding a ferromagnetic resonator 1101. The compensating network may be in the form of a multi-section transmission line transformer as shown in FIG. 12. This Figure illustrates in schematic form a compensating network comprising transmission lines 1203 and 1204, each of which has a different characteristic admittance and electrical length. The lines are connected in series, supplying power from a source generator 1206 with a source admittance 1205 to a coupling loop 1202 which surrounds a ferromagnetic resonator 1201.

Having described my invention, I claim:

1. A method for reducing the change in input and output resonator bandwidth of a loop coupled ferromagnetic resonator filter by compensating for variations in coupling over multi-octave tuning ranges comprising:

determining the variation in bandwidth due to the coupling loop acting as a transmission line transformer transforming respective source or load admittance $G_o$ to an equivalent conductance $G_p$;

determining bandwidth variation selectively as a function of frequency; and compensating said bandwidth variation with a frequency selective compensating transmission line providing a variation in bandwidth determined by said second step oppositely to and compensating said variation in bandwidth due to said coupling loop acting as a transmission line transformer, whereby to compensate coupling variation with frequency, and provide a substantially constant passband over multi-octave ranges.

2. A method for providing a change in input and output resonator bandwidth which changes at substantially the same rate as the change in bandwidth between adjacent resonators in a multi-loop coupled ferromagnetic resonator filter comprising:

determining the variation in bandwidth between adjacent resonators due to the coupling loop acting as a transmission line transformer;

determining bandwidth variation between adjacent resonators selectively as a function of frequency; and matching said bandwidth variation in input and output coupling with a frequency selective compensating transmission line providing a variation in bandwidth as a function of frequency determined by said second step to match said variation in bandwidth due to said coupling loop acting as a transmission line transformer, whereby to compensate coupling variation with frequency, and provide a substantially constant passband ripple over multi-octave ranges.

* * * * *